US009080413B2

(12) United States Patent
Winnon

(10) Patent No.: US 9,080,413 B2
(45) Date of Patent: Jul. 14, 2015

(54) DOWNHOLE PRESSURE NOZZLE AND WASHING NOZZLE

(71) Applicant: James Randall Winnon, Collinston, LA (US)

(72) Inventor: James Randall Winnon, Collinston, LA (US)

( * ) Notice: Subject to any disclaimer, the term of this patent is extended or adjusted under 35 U.S.C. 154(b) by 293 days.

(21) Appl. No.: 13/770,691

(22) Filed: Feb. 19, 2013

(65) Prior Publication Data

US 2014/0209295 A1 Jul. 31, 2014

Related U.S. Application Data

(60) Provisional application No. 61/758,526, filed on Jan. 30, 2013.

(51) Int. Cl.
*E21B 37/08* (2006.01)
*E21B 41/00* (2006.01)

(52) U.S. Cl.
CPC ..... *E21B 37/08* (2013.01); *E21B 41/0078* (2013.01)

(58) Field of Classification Search
CPC ..... E21B 41/0078; E21B 37/08
USPC ..... 166/222, 312
See application file for complete search history.

(56) References Cited

U.S. PATENT DOCUMENTS

| | | | | | |
|---|---|---|---|---|---|
| 1,379,815 | A | | 5/1921 | Hall | |
| 3,142,306 | A | | 7/1964 | Boka, Jr. | |
| 3,856,084 | A | | 12/1974 | Parsons | |
| 3,912,173 | A | * | 10/1975 | Robichaux | 239/443 |
| 4,618,010 | A | * | 10/1986 | Falgout et al. | 175/430 |
| 4,697,654 | A | * | 10/1987 | Barr et al. | 175/430 |
| 5,337,819 | A | | 8/1994 | Tailby | |
| 5,462,129 | A | * | 10/1995 | Best et al. | 175/67 |
| 6,039,117 | A | | 3/2000 | Mueller | |
| 6,062,311 | A | | 5/2000 | Johnson | |
| 6,776,231 | B2 | | 8/2004 | Allen | |
| 7,296,627 | B2 | | 11/2007 | Dyer | |
| 7,497,261 | B2 | | 3/2009 | Dyer | |
| 7,913,763 | B2 | | 3/2011 | D'Amico | |
| 2006/0086507 | A1 | | 4/2006 | Surjaatmadja | |

* cited by examiner

*Primary Examiner* — Jennifer H Gay
*Assistant Examiner* — George Gray
(74) *Attorney, Agent, or Firm* — GableGotwals

(57) ABSTRACT

A nozzle apparatus that can be inserted downhole into a well casing has an attachment component at an open end of a hollow cylinder that is in communication with a pressurized liquid supply source. The hollow cylinder extends from the attachment component and has a closed end. A plurality of apertures extend from an interior surface of the hollow cylinder to an outer surface of the hollow cylinder sides. The outer surface of the nozzle cylinder can be uneven. The outer surface of the nozzle cylinder can have an unequal radius. The nozzle surface can contain bypass slits. In one embodiment the nozzle can have a threaded attachment component at the bottom. A scraper or other cleaning device can be attached to the threaded component.

8 Claims, 4 Drawing Sheets

Bottom View

Top View

Side View
4
3
8 7/8"
3
7 1/2"
6
6 3/8"
7
7
7
3
3
Length 10 1/2"
2
6
4 3/8"
Width
3 5/8"
3 5/8"
7
7
3
3
6
1 5/8"
9
3/4"
3
3
Appendage For
Scraper Dimensions
Same As Item 4
Outside of threads 2 9/16"

DOWNHOLE PRESSURE NOZZLE AND WASHING NOZZLE

RELATED APPLICATION

This application claims the benefit of and priority to and incorporates by reference herein Provisional Application 61/758,526 filed Jan. 30, 2013 and entitled "Downhole Pressure Nozzle and Washing Nozzle".

BACKGROUND OF DISCLOSURE

1. Field of Use

The device subject of this invention is a nozzle that can be inserted and lowered into a cased borehole. Typically this can be a hydrocarbon production well.

2. Related Technology

Hydrocarbon production wells typically comprise a borehole. Inserted into the borehole is casing, i.e., elongated pipe segments interconnected that create an inner annulus through which production equipment can be lowered. Typically an annular spacing remains between the wall of the geologic formation (borehole) and the outer diameter of the well casing. The casing is perforated at selected locations. The perforation process also creates fissures in the geologic formation. This releases the oil, gas or water entrapped in the formation. The oil and gas flows into the well bore casing.

SUMMARY OF INVENTION

Over time, perforations in the wellbore may narrow or become clogged. This impedes the flow of oil and gas into the casing. This impedes production from the well. The clogging material may be a variety of substances such as drilling mud, heavy oils, paraffin or debris from the fracturing of the formation. Other materials can obstruct the perforations. The productivity of the well can be severely impaired.

Disclosed in this specification is a nozzle device. The outer diameter of the nozzle is dimensioned to fit within the inner diameter of a well casing. The body of the nozzle can be metal or other material capable of withstanding high pressure. For example the nozzle body may be made of steel. The nozzle housing may be hollow. Machined into the nozzle housing are holes which extend from the outer surface of the nozzle housing through to the hollow chamber or annulus. The nozzle housing may contain slits machined into the outer surface of the nozzle to facilitate the passage of fluids or debris past the nozzle.

The holes or housing perforations are of a specific dimension. The perforations can be oriented to the sides of the nozzle body. The perforations can also extend from the bottom of the nozzle body.

The nozzle housing or body can be in an approximate cylindrical shape. In one embodiment, the exterior of the nozzle housing has rounded surfaces. For example the edge of the bottom surface meeting the cylinder sides is rounded. The exterior of the nozzle housing has variable diameters. The differing diameters are joined by curved surfaces.

With the cylindrical shape of the nozzle housing, it will therefore have a longitudinal axis extending the length of the cylinder shape. The cylinder has radial axes that extend to the side wall of the nozzle housing. The perforations may extend through the cylinder wall at an angle to a radial axis. In one embodiment, the side perforations are at 90° angle to the cylinder side wall. (No angle of deflection to the radius extending from the longitudinal axis.) In another embodiment, the side perforations may be 85° to the cylinder side wall (or at an angle 5° to a radius extending from the longitudinal axis, or 175°). In another embodiment, the bottom perforations are at an angle 10° of the longitudinal axis of the housing.

As stated, the nozzle can be connected to a liquid conveying device. This may be a hose, reinforced hose or pressure rated hose. In an embodiment, the liquid is pressurized. The liquid conveying device may be a metal tube. The nozzle may also be attached to a wire line. The liquid conveying device conveys pressurized liquid. The nozzle housing can be connected by a common threaded combination. The nozzle housing can be equipped with the male threaded component that is compatible to the female threaded component of a pipe end. In another embodiment, the housing can be connected to the liquid conveying component using toggle bolts. Other hose or pipe attachments may be used.

In another embodiment, the nozzle housing can incorporate a rotating coupling that allows the nozzle to rotate around a longitudinal axis of the nozzle cylindrical housing. The rotation can be powered by the pressure of the liquid. The nozzle can contain a rotating device such as angled blades attached to the cylinder wall within the interior of the nozzle housing.

The liquid can be water, gray water (treated waste water), acid solution or other substances. The liquid can be sprayed from the nozzle tested at 10,000 psi and with a working pressure 5,000 psi or no higher than the working strain of the casing will allow.

The nozzle can be attached to a hose or piping which is lowered into the well casing a selected distance. The nozzle can also be attached to metal tubing such as coiled or spooled metal tubing. The nozzle can also be connected to a wire line for support. The nozzle with the tubing, hose or piping is lowered in a manner known in the industry. When the nozzle reaches a target depth, such as clogged or partially clogged casing perforations, the pumps pumping the liquid through the hose, tubing or pipe can be activated and the pressurized liquid flows through the orifices of the nozzle. It will be appreciated that in one embodiment the liquid can be heated.

The nozzle can be used in conjunction with a centralizer. A centralizer is a hinged component attached to the pipe, hose or tube that holds the nozzle in the center of the casing. It may contain a flexible bow in the middle of the centralizer to keep the tubing in the center of the casing.

The nozzle can be adapted for use with a scraper component such as one or more wire brushes or blades. These components can be placed in contact with the sides of the well casing. The scrapers can contact the well casing through spring tension pushing pivoting arms apart. The scrapers can also be used in conjunction with rollers traversing the well casing side. In another embodiment, the force of the liquid pressure forces the scraper against the casing wall. The scraper may be attached to a threaded coupling at the bottom of the cylinder housing.

The apertures of the nozzle housing can be fitted with threaded inserts (orifice jets) which can restrict the diameter of the aperture. These jets can increase the pressure and narrow the stream of liquid from the nozzle. The jets can also change the direction of the stream, e.g., cause the liquid stream to exit the nozzle housing at an angle to the radius. The inserts can also serve as plugs to selected nozzle apertures. Such plug inserts do not have an opening for liquid flow. In another embodiment, the apertures are not threaded and pressurized liquid is forced through the apertures to the well casing and perforations.

In addition to the liquid contacting the perforations of the well casing, the liquid will be forced out horizontally by the pressure through the well casing perforations and into the adjacent geologic formation. The force of the pressurized liquid can force open fissures in the formation and cause liquid to penetrate past the length of the fractures within the formation.

SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

DETAILED DESCRIPTION OF THE DISCLOSURE

The nozzle has a cylindrical shape. It has cylindrical sides and a bottom. The top attaches to a pipe, hose or tube conveying liquid under pressure. The top of the nozzle may comprise a male threaded component which fits into a compatible female threaded connection on the hose, pipe or tube. The top of the cylinder also contains a center hole or annulus that is in liquid communication with side and bottom apertures of the nozzle.

In one embodiment, the nozzle may spin or rotate at the end of the pipe. The male threaded component may comprise a two part rotation collar. The upper portion comprises the threaded portion of the collar. This portion of the collar can be fixed to the liquid conveying pipe, hose or tubing. The lower portion comprises the nozzle body which is rotatably fixed to the upper collar. The nozzle can rotate around the longitudinal axis of the nozzle body. In one embodiment angled baffles may be fixed to the interior of the nozzle annulus. The force of the liquid flowing through the pipe and collar strikes the baffles and causes the nozzle to rotate around the longitudinal axis and along the rotatable fixture attached to the upper collar.

It will be appreciated that the nozzle body may have various shapes and dimensions. The following is merely one embodiment and the disclosure is not limited to this description.

Figure 1:
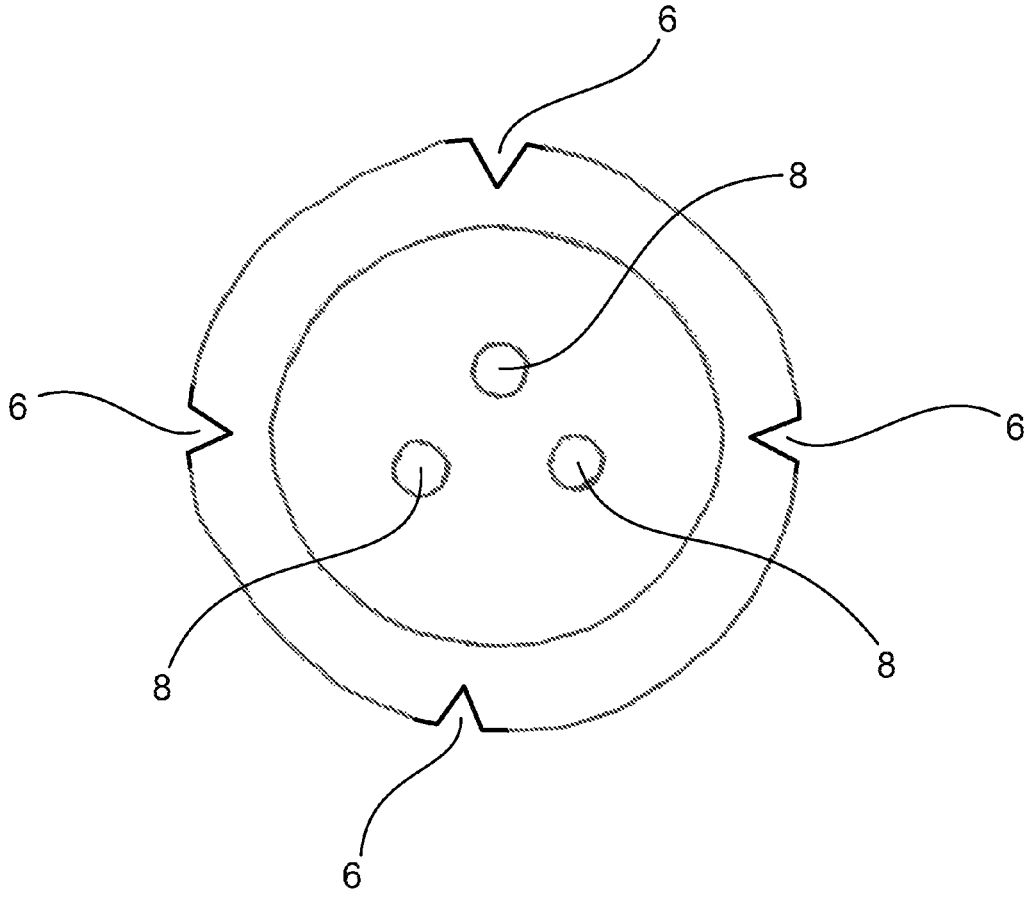
FIG. 1 illustrates a bottom view of one embodiment of the cylindrical shaped nozzle showing 3 bottom orifices or apertures and 4 side grooves (bypass slits) extending from the cylinder sides in a longitudinal direction.

FIG. 1 illustrates a bottom view of the cylindrical shaped nozzle. The closed bottom end is illustrated with 3 apertures 8. In one embodiment, the aperture has a diameter of ⅜ inches. In another embodiment, additional apertures may be installed in the closed bottom end. Liquid can flow out of these apertures into the well casing. The liquid source is the pipe, tubing or hose and flows through the center annulus at the top of the cylinder housing. These apertures can be used to flush material from the bottom of the well. It will be appreciated that the interior of the cylinder is hollow and liquid flowing into the nozzle from the hose, tubing or pipe can flow out of the apertures under pressure. The apertures 8 can be angled, i.e., non parallel to the longitudinal axis of the cylindrical shaped axis. For example, in one embodiment, the apertures can be 10° to the longitudinal axis. It will be appreciated that the angled apertures facilitates the pressurized liquid contacting the sides of the well casing. The angled apertures also may facilitate rotation of the nozzle as described above.

In one embodiment, the pressure may be regulated with the pump speed to create a pulsating flow through the nozzle.

Also illustrated in FIG. 1 is a side view of the of 4 bypass slits 6 oriented radially from the side cylinder wall. The bypass slits extend into the side wall thickness of the nozzle. The bypass slits extend into the wide or broad sections of the nozzle diameter. This can be seen in FIG. 2. In one embodiment, the slits can extend approximately ½ inch deep. In one embodiment, the slits form a two sided V shaped groove extending longitudinally on the outer surface of the nozzle cylinder.

The slits are cut for two reasons. First, the slits allow fluid to pass as the nozzle is lowered into the casing. If they were not in place and the tool was substantially round, it would cause a compression of the underlying liquid and make it difficult to lower the nozzle into the well. Second, the slits allow trash and debris to be flushed past the nozzle when washing on the bottom.

Figure 2:
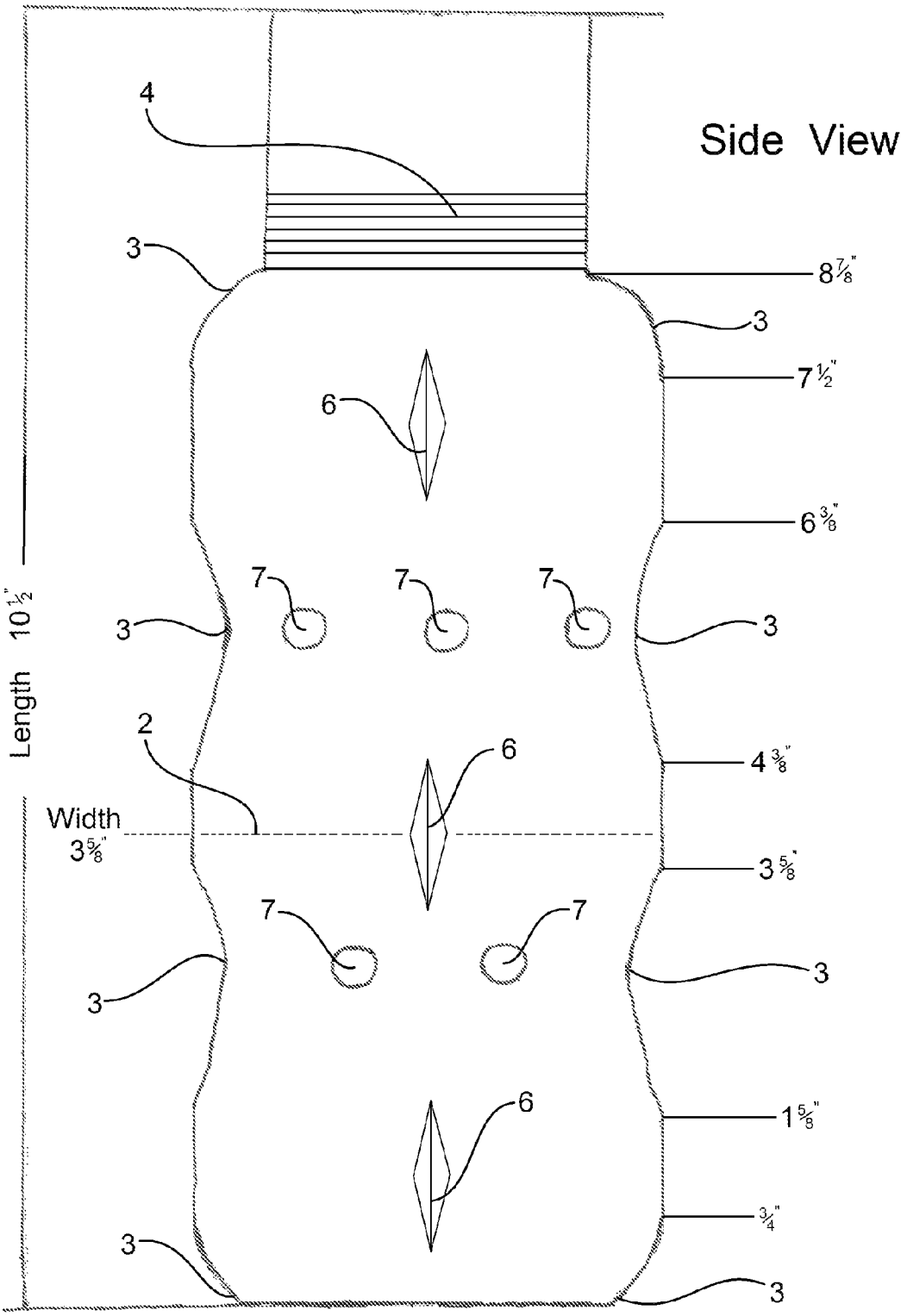
FIG. 2 illustrates a side view of one embodiment of the nozzle being approximately a cylindrical shaped structure with multiple orifices. Also illustrated are multiple bypass slits that extend through the expanded portion of the nozzle housing wall. Further illustrated is the threaded coupling mechanism attaching the nozzle to the pipe component. Also illustrated are the rounded shapes of the cylinder bottom joining the side wall and the rounded shape or curved transitions of the varying diameters of the cylinder housing.

FIG. 2 illustrates an embodiment of the nozzle cylinder where multiple sets of apertures 7 are positioned around a narrowed portion (band) of the cylinder radius 3. The apertures may be fitted with orifice jets (not shown). Orifice jets can further pressurize and direct the stream emitted from the aperture. For example, in the embodiment illustrated in FIG. 2, the first set of 8 apertures 7 are circular and may be ⅜ inch diameter. The orifice jets may have narrowed apertures of 1/16 inch, ⅛ inch or 3/32 inch. Other dimensions are within the scope of this disclosure. The aperture 7 may be threaded. There are also more apertures, i.e., 8 comprising the second set also located in a narrow band of the nozzle radius. It will be appreciated that there a two bands of 8 apertures in the narrow bands of the cylinder illustrated in FIG. 2.

It will be appreciated that in one embodiment, the total area of the aperture openings is less than the vertically oriented area of the tubing, pipe or hose conveying liquid into the nozzle. A higher volume of liquid can be conveyed into the nozzle than emitted out. This also facilitates maintaining high pressure on the liquid exiting the nozzle through the apertures.

It will be appreciated that the orifice jets may direct the liquid stream at an angle to the radius of the nozzle housing. In one example, orifice jets are oriented 170° to the radius extending from the longitudinal axis of the nozzle. (This is deflecting the stream 10° and 80° to the surface of the side wall.) The angle may be an a horizontal orientation (normal to the longitudinal axis of the cylinder) or may have a vertical component of orientation. This angle will propel the pressurized liquid at an angle to the radius and may be used to facilitate rotation of the nozzle. The directional orientation of the orifice jets can be aligned for maximum effect.

Also illustrated are three of the 12 bypass slits. See FIG. 2. In one embodiment, there may be four bypass slits within each wide circumferential band of the nozzle housing. The four bypass slits are positioned 90° apart. It will be appreciated that the bypass slits are positioned at a wide band 2 of the illustrated cylinder radius. Additional bypass slits can be installed in the cylinder housing. In one embodiment, there can be no bypass slits in the cylinder housing.

FIG. 2 illustrates one embodiment of the cylinder housing comprising the nozzle. Illustrated is a second set of 8 circular apertures 7 located at a narrowed portion of the cylinder radius 3. The diameter at the narrowed radius of the nozzle housing is 3 1/16 inches. There are 8 circular apertures 3/8 inches round. These can be tapped (threaded) holes. The threads can be 3/8×3/8-8 socket set screws.

In one embodiment, the number of apertures can vary between the first and second row. In another embodiment, the top and bottom rows are offset 22.5° from the adjacent row. In each row, the 8 apertures are spaced 45° apart.

Orifice jets can be screwed into threads of the circular apertures 7 & 8.

Also illustrated is a third row of 4 bypass slits 6 located at a broad radius of the cylinder. It will appreciated that the bypass slits can be vertically aligned as shown in FIG. 2. It will also be appreciated that the radius or diameter of the cylinder can vary along the length of the cylinder. As illustrated in FIG. 2, the cylinder has a narrow base 3 and a widen radius band (where 4 four sided bypass slits 6 are positioned) at approximately 3/4 inches above the base and extending to approximately 1 5/8 inches above the base. There is a second narrowed radius band 3 where the 8 circular apertures 7 are positioned and a second wide radius band 2 of the cylinder where a second set of 4 bypass slits are positioned. The circular apertures are positioned on the cylinder sides. The apertures may also be of a non-circular shape such as square, triangular or diamond shaped. They also can have serrated edges. This second wide portion of the radius extends from approximately 3 5/8 inches to approximately 4 3/8 inches above the base. FIG. 2 illustrates a second narrowed portion of the cylinder where the second group of 8 circular apertures 7 are positioned. The cylinder again widens at approximately 6 3/8 inches and extends to approximately 7 1/2 inches. The cylinder then narrows at the top 3 at the coupling mechanism, e.g. threaded coupling. The threads can be 2 and 3/8-8 round. The cylinder, perforated with apertures as described above, and containing undulations as described, can, in one embodiment, be approximately 8 7/8 inches tall and with a diameter of 3 5/8 at its widest point. Other sizes and exterior shapes are within the scope of this disclosure. The dimensions stated above illustrate only one embodiment of the invention.

The 16 side holes 7 and 3 bottom holes can be blocked off with blank set screws, e.g., 3/8 inch set screws, to make the tool perform a different task. For example, if the three bottom holes 8 (shown in FIG. 1) are blocked with blanks and the upper holes are open or with 1/8 inch jets, the tool can be used as a side washer or perforator tool according to the orifice size and pressure used. In another example, inserting blocks on most or all side apertures and inserting orifice jets on the bottom aperture allows the nozzle to be used to flush or wash the bottom of the well.

Figure 3:
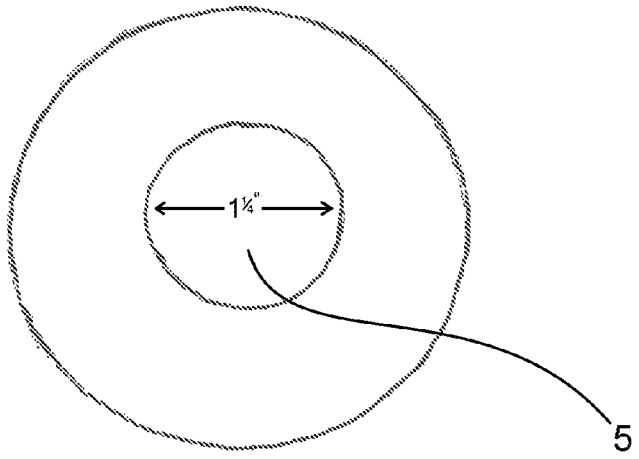
FIG. 3 illustrates a top view if one embodiment of the nozzle showing the center hole comprising an inner annulus.

FIG. 3 illustrates a top view of the cylinder. Illustrated is the narrow connecting point at the cylinder top of 1 1/4 inches. This disclosure is not limited to this dimension. Also illustrated is the center annulus 5 of the cylinder in communication with the above described apertures.

In the embodiment illustrated, the nozzle exterior comprises two undulations or exterior radii. In one embodiment, all edges are rounded. This shape facilitates maneuvering of the nozzle within the well casing. For example the exterior shape with edges or angled structure may impede the nozzle traversing the well casing. For example, edges may cause the nozzle to hang-up on a well casing collar. Further, the wide center diameter fits proximately to the well casing sides and thereby spaces the apertures 7 away from the well casing. This allows a stream to form exiting the aperture before hitting the casing wall. This enhances the cleaning impact of the liquid stream on the casing wall.

The nozzle is deployed down a well casing. The nozzle is first attached to a liquid conveying component that is attached to a liquid source and a pump. The liquid conveying component can be a hose, pipe, or tube. The liquid conveying component will be able to withstand the force of pressurized liquid.

The nozzle is deployed to an intended depth of the well casing. This may be a section or zone of the well casing containing perforation holes used in the extraction of hydrocarbon. The zone of perforation may have been created by a fracking gun using explosive charges or pressurized liquid. These perforation holes may have become obstructed over time. The nozzle is subjected to liquid pressure. The pressurized liquid exits from the apertures of the nozzle and is directed at the well casing within the perforation zone. The force of the pressure will disperse the material clogging or obstructing the perforation zone. The pressurized liquid penetrates through the perforation zone of well casing and into the geologic formation previously fractured by the fracking gun. The force of the liquid penetrates into the geologic formation to disperse drilling mud, paraffin or heavy hydrocarbon that are impeding the flow of hydrocarbon through the fracture zone of the well casing. This process can increase the production of hydrocarbon from the well.

In one embodiment, the nozzle can be positioned downhole and pressurized liquid activated. The liquid flow can be stopped, the nozzle returned to the surface. The nozzle can then be rotated 12.25° and reinserted into the well casing and pressurized liquid reactivated. This ensures that a nozzle orifice is directly oriented to all sides (360°) of the well casing.

In another embodiment, the cylindrical body of the nozzle can be lengthen and an additional row of 8 orifices can be installed radially offset 12.25°. In yet another embodiment the radial spacing between each aperture can be modified, e.g., reduced. For example, 12 apertures could be installed with 30° spacing around the circumference of the nozzle. In yet another embodiment, the shape of each orifice could be modified to create a desired spray pattern such as a spiral.

This procedure can be practiced through the deployment of packers above and below the perforation zone. This can direct more of the liquid into the target area of the casing and formation. The packers are inflatable components that seal or isolate a section of the well casing.

This procedure can also be practiced with a rotating nozzle dispersing liquids at high pressure. The turning of the nozzle will cause the apertures of the nozzle to change orientation and thereby ensuring that every square inch of the well casing in the fracture zone is subjected to high pressure.

Figure 4:
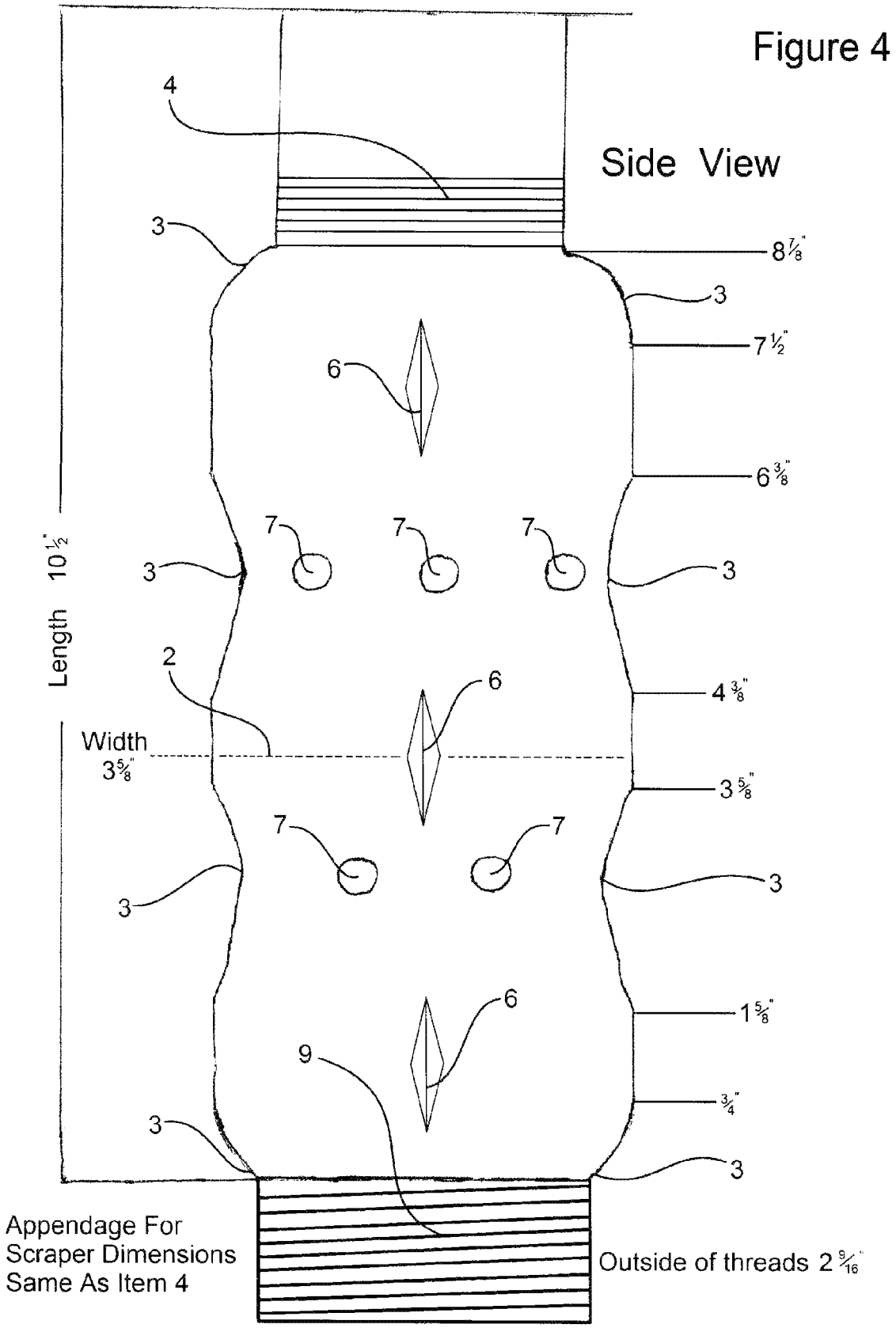
FIG. 4 illustrates the nozzle comprising a separate threaded component that can be used for the attachment of a scraper or other component.

As shown in FIG. 4, the nozzle can also be adapted for use with a casing side wall scraper or other component. In one embodiment, the cylinder housing can be equipped with a threaded section 9 located on the exterior surface at the bottom section of the cylinder housing. This can be a threaded segment similar to the threaded coupling component 4 illustrated in FIG. 2. The threaded component can have a narrower diameter or other configuration. The scraping component can be threaded onto the nozzle cylinder housing before deployment down the wellbore. The scraper can have various embodiments including stationary blade or rotating blades. The blades can be pressed to the casing side wall by spring tension. This may use pivoting arms attached to the scraper coupling component wherein the arms are pressed apart by one or more springs. In another embodiment the cylinder housing can be equipped with a rotor at the closed end of the cylinder. The rotor, centered on the longitudinal axis, rotates from the pressure of the liquid entering the top of the cylinder. The rotating shaft extends through the bottom of the cylinder turns the rotating blades or wire brush devices. Liquid can flow through the bottom holes 8 shown in FIG. 1. This would facilitate the washing function. In another embodiment, the scraper component comprises one or more wire brushes in contact with the casing wall.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

What I claim is:

1. A nozzle apparatus for insertion downhole into a well casing, the nozzle apparatus comprises:

a) an attachment component of a nozzle at an open end of a hollow cylinder arranged for attachment to a pressurized liquid supply source;

b) the hollow cylinder extending from the attachment component with a side wall and a closed cylinder end, the side wall having at least two alternating bands of wide radius and narrow radius;

c) said narrow radius bands having a plurality of apertures extending through an interior surface of the side wall to an outer surface of the side wall; and d) said wide radius bands having a plurality of bypass slits on the outer surface of the cylinder side wall and no apertures.

2. The nozzle apparatus of claim 1 further comprising at least one aperture in the closed cylinder end.

3. The nozzle apparatus of claim 2 further comprising an aperture at the closed end oriented at an angle to a longitudinal axis of the cylinder.

4. The nozzle apparatus of claim 1 further comprising at least one aperture of the plurality of apertures extending through the side wall at an angle to a cylinder radius.

5. The nozzle apparatus of claim 1 further comprising tapered or rounded surfaces between at least one of the bands of wide radius and narrow radius.

6. The nozzle apparatus of claim 1 further comprising the said wide radius bands sized to offset the plurality of apertures of said narrow radius bands from a downhole casing wall.

7. The nozzle apparatus of claim 1 further comprising the attachment having a threaded coupling connector attachable to a pipe, tube or hose.

8. The nozzle apparatus of claim 1 further comprising at least one aperture of the plurality of apertures being angled relative to the horizontal plane of said bands of the narrow radius.

* * * * *